US008378821B2

(12) United States Patent
Edelstein et al.

(10) Patent No.: US 8,378,821 B2
(45) **Date of Patent: *Feb. 19, 2013**

(54) PLUGGABLE SECURITY DEVICE

(75) Inventors: Fredric Edelstein, Westmount (CA); James Morrison, Sebringville (CA)

(73) Assignee: Cicada Security Technology Inc., Westmount (CA)

( * ) Notice: Subject to any disclaimer, the term of this patent is extended or adjusted under 35 U.S.C. 154(b) by 167 days.

This patent is subject to a terminal disclaimer.

(21) Appl. No.: 12/732,624

(22) Filed: Mar. 26, 2010

(65) Prior Publication Data

US 2011/0187532 A1 Aug. 4, 2011

Related U.S. Application Data

(60) Provisional application No. 61/300,528, filed on Feb. 2, 2010.

(51) Int. Cl.
*G08B 13/14* (2006.01)

(52) U.S. Cl. ..... 340/568.1; 340/539.1; 340/539.11

(58) Field of Classification Search ..... 726/34–36; 340/500, 540, 568.1, 571, 505, 568.2, 384.6, 340/384.7, 539.11, 825

See application file for complete search history.

(56) References Cited

U.S. PATENT DOCUMENTS

| | | | | |
|---|---|---|---|---|
| 4,845,464 | A | 7/1989 | Drori et al. | |
| 5,317,304 | A | 5/1994 | Choi | |
| 5,317,305 | A | 5/1994 | Campman | |
| 5,748,083 | A | 5/1998 | Rietkerk | |
| 6,038,320 | A | 3/2000 | Miller | |
| 6,111,504 | A | 8/2000 | Packard et al. | |
| 6,133,830 | A | 10/2000 | D'Angelo et al. | |
| 6,147,603 | A | 11/2000 | Rand | |
| 6,150,940 | A | 11/2000 | Chapman et al. | |
| 6,172,607 | B1 | 1/2001 | McDonald | |
| 6,882,334 | B1 * | 4/2005 | Meyer | 345/156 |
| 6,970,081 | B1 | 11/2005 | Cheng | |
| 7,026,933 | B2 | 4/2006 | Kim | 340/568.1 |
| 7,068,168 | B2 | 6/2006 | Girshovich et al. | |
| 7,135,971 | B2 | 11/2006 | Kim | |
| 7,305,714 | B2 | 12/2007 | Hamaguchi et al. | |
| 7,362,227 | B2 | 4/2008 | Kim | |

(Continued)

FOREIGN PATENT DOCUMENTS

| | | | |
|---|---|---|---|
| GB | 2316211 | A | 2/1998 |
| GB | 2458849 | A | 7/2009 |

(Continued)

OTHER PUBLICATIONS

"GadgetTrak Advanced Laptop Anti-Theft Software", GadgetTrak, www.gadgettrak.com, 2 pages.

(Continued)

*Primary Examiner* — Brian Zimmerman
*Assistant Examiner* — An T Nguyen
(74) *Attorney, Agent, or Firm* — Volentine & Whitt, PLLC

(57) ABSTRACT

A pluggable security device for protecting an electronic device, such as a laptop, is disclosed. The pluggable security device has a battery, a siren, and an optional accelerometer. The security device is triggered by unplugging from the electronic device, or by sensing acceleration, or by disconnecting the electronic device from AC power or from a network. Once the security device is triggered and its internal siren is activated, it can only be deactivated by reinserting the pluggable security device into the electronic device it has been disconnected from and by entering a password in the electronic device.

18 Claims, 5 Drawing Sheets

U.S. PATENT DOCUMENTS

| | | | | |
|---|---|---|---|---|
| 7,528,718 | B2 * | 5/2009 | Adapathya et al. | 340/571 |
| 7,741,974 | B1 | 6/2010 | Kuo | |
| 7,772,972 | B2 * | 8/2010 | Kuroda et al. | 340/506 |
| 7,804,403 | B2 * | 9/2010 | Chantelou et al. | 340/539.1 |
| 7,825,820 | B2 | 11/2010 | Lee | |
| 2002/0108058 | A1 * | 8/2002 | Iwamura | 713/201 |
| 2002/0171546 | A1 * | 11/2002 | Evans et al. | 340/540 |
| 2003/0014660 | A1 * | 1/2003 | Verplaetse et al. | 713/200 |
| 2004/0056759 | A1 | 3/2004 | Ungs | |
| 2004/0086090 | A1 * | 5/2004 | Naidoo et al. | 379/37 |
| 2004/0257208 | A1 * | 12/2004 | Huang et al. | 340/426.1 |
| 2005/0174229 | A1 * | 8/2005 | Feldkamp et al. | 340/506 |
| 2006/0005264 | A1 | 1/2006 | Lin et al. | |
| 2006/0112418 | A1 | 5/2006 | Bantz et al. | |
| 2006/0149871 | A1 | 7/2006 | Marshall et al. | |
| 2006/0152365 | A1 * | 7/2006 | Kim | 340/571 |
| 2008/0106366 | A1 | 5/2008 | Zhang et al. | |
| 2008/0178304 | A1 | 7/2008 | Jeansonne et al. | |
| 2008/0180244 | A1 | 7/2008 | Howarth et al. | |
| 2008/0266089 | A1 * | 10/2008 | Haren et al. | 340/568.1 |
| 2008/0316024 | A1 * | 12/2008 | Chantelou et al. | 340/539.17 |
| 2009/0097215 | A1 * | 4/2009 | Hiew et al. | 361/757 |
| 2009/0189765 | A1 | 7/2009 | Lev et al. | |
| 2009/0303066 | A1 * | 12/2009 | Lee et al. | 340/679 |
| 2010/0033329 | A1 | 2/2010 | Davis et al. | |
| 2010/0241739 | A1 | 9/2010 | Reus et al. | |
| 2010/0277315 | A1 * | 11/2010 | Cohn et al. | 340/540 |

FOREIGN PATENT DOCUMENTS

| | | | |
|---|---|---|---|
| WO | 2010017516 | A1 | 2/2010 |

OTHER PUBLICATIONS

Li Hui et al., "Design and application of new kind of electronic and mechanical antitheft lock using DSP", Computer, Mechatronics, Control and Electronic, Engineering (CMCE), 2010 International Conference on. Aug. 24-26, 2010, Changchun, China. vol. 4, (Abstract only) 1 page.

"Intel Anti-Theft Technology (Intel AT) for Laptop Security" www.intel.com, 1 page.

"Software protection dongle", from Wikipedia, http://en.wikipedia.org/wiki/Software_protection_dongle, pp. 1-6.

Ka Yang et al., "EagleVision: A pervasive mobile device protection system", Mobile and Ubiquitous Systems: Networking & Services, MobiQuitous, 2009, pp. 1-10.

Dafna Zilafro et al., "Targus, Inc. Partners With Caved Technology to Introduce Advanced Security Solutions for Notebook Computers", Cavo Technology, Nov. 5, 2002, pp. 1-2.

"Belkin USB Laptop Alarm Eliminates Theft, One Decibel at a Time" Nov. 15, 2007, www.everythingusb.com. 1 page.

* cited by examiner

PLUGGABLE SECURITY DEVICE

CROSS-REFERENCE TO RELATED APPLICATIONS

The present invention claims priority from U.S. provisional patent application No. 61/300,528 filed Feb. 2, 2010, which is incorporated herein by reference.

TECHNICAL FIELD

The present invention relates to security devices, and in particular to security devices pluggable into electronic devices, for protecting the electronic devices from unauthorized use, tampering, or theft.

BACKGROUND OF THE INVENTION

Personal computers are commonly used in work environments where an operator is not always present. A computer store, a computer equipped laboratory or a conference room, and an Internet café are examples of such environments. Mobile workers and consultants frequently travel with personal computers, taking them to public places. Personal computers, in particular laptop computers, pose an opportunity for theft of high value assets. Because laptop computers are relatively easy to carry and resell, they are one of the most frequently stolen articles.

According to studies conducted over the years, computer data is rarely backed up or encrypted as often as a good practice would require. Consequently, when a theft occurs, considerable amounts of work and private information are left in hands of unauthorized parties. The theft of personal computers results in loss of data and productivity. Furthermore, the user's private information left in hands of unauthorized parties can result in an identity theft, as well. Nowadays, regulatory compliance dictates severe penalties to corporations and their directors for the unintentional disclosure of private or confidential information. Personal banking, shopping, and personal communication is commonly done using personal computers. Thus, an identity theft can result in very serious consequences for the owner of a stolen computer.

The current security solutions for laptop computers and other portable electronic devices can be categorized into "physical", "phone-home", and "alarm" security solutions. Most commercially available security products fall into one of these three categories.

Physical security products are designed to connect the device being protected to a static object, or to a heavy, difficult to carry object. These products include locks, locks with tension alarms, or glue pads. The effectiveness of these security products is limited to the strength of the materials used for device attachment, and typically can only offer a limited protection. In many cases, the exertion of minor to moderate force can easily disengage the lock type devices from the anchor hole in notebook computers. Where glue pads are used, the electronic device is affixed to the desk making it a semi-permanent installation, and rendering the electronic device not portable.

"Phone-home" security solutions employ a difficult to remove embedded software that will "ping" home the next time the stolen electronic device is connected to the Internet or a phone line. However, it could be weeks before the device is resold and connected to the Internet. The stolen device could have already been moved to a faraway location, and the data that were stored by the storage device such as a hard drive could have already been erased or copied by the wrongdoer. As a result, the effectiveness of these types of solutions in preserving the data and the work done is quite limited.

"Alarm" security products are constructed to prevent a theft of an asset by sounding a loud alarm signal during an attempted theft, for example when the asset is moved. They are similar to car alarm systems equipped with electronic switches and motion sensors.

In U.S. Pat. No. 5,317,304, which is incorporated herein by reference, Choi discloses a security system for preventing computer theft. The security system of Choi has a microprocessor controlled alarm sensor connected to motion and contact sensors. It has a key pad, a display, and a siren for sounding an alarm. The motion sensor is a mercury switch or a piezo sensor. The security system of Choi does not interact with the host computer, the theft of which it is intended to prevent, and is similar to a home intrusion security system. Disadvantageously, the security system of Choi is rather bulky. It requires a physical attachment to the host computer.

In U.S. Pat. No. 6,147,603, which is incorporated herein by reference, R and discloses an anti-theft system that uses a customized Universal Serial Bus (USB) cable with an integrated security circuit to monitor removal or loss of the USB connection to a host monitoring system. When the USB connection is lost, an alarm is activated. This system is limited to use in environments where a centralized monitoring system can be deployed, such as a retail showroom or an office.

In U.S. Pat. No. 7,068,168, which is incorporated herein by reference, Girshovich et al. disclose an anti-theft system for protecting computers and other high-value assets from theft. The system of Girshovich et al. has a wireless transmitter device integrated into the asset to be protected. When a theft is detected, the transmitter is activated and sends a signal to a receiver, which in turn activates an alarm. Disadvantageously, the security system of Girshovich et al. requires a physical integration with the asset to be protected.

In U.S. Pat. Nos. 7,026,933 and 7,135,971, which are incorporated herein by reference, Kim discloses an anti-theft security device connectable to a USB port of a portable computer. The Kim device has a motion detector and an alarm sub-system which can be triggered by motion or by unplugging the device from the host computer. The Kim device is controlled by a remote wireless controller. Disadvantageously, the remote wireless controller represents a substantial security concern. Indeed, signals from the remote wireless controller can be intercepted and emulated to deactivate the alarm devices; or the wireless controller itself can be stolen. Furthermore, the Kim device is permanently affixed to a cover of the device being protected.

In U.S. Pat. No. 7,305,714, which is incorporated herein by reference, Hamaguchi et al. disclose a USB pluggable anti-theft device including a microprocessor controlled accelerometer and a siren for sounding an alarm. The device of Hamaguchi et al. continuously senses acceleration and temperature, providing both visual and audible alert signals upon triggering by either acceleration or temperature exceeding preset thresholds. Disadvantageously, the device of Hamaguchi et al. is completely deactivated by disconnection from the host device it is plugged into. The controller software is automatically uninstalled once the device of Hamaguchi et al. is disconnected from the host computer.

The prior art is lacking a security device that would be versatile and reliable, easy to install and uninstall, while providing a high degree of protection against unauthorized access or theft.

The ease of use of a security device is nearly as important the degree of protection that is offered by the device. If the security device is cumbersome or troublesome to use, it may not be used in actual practice, so that the computer it is intended to protect will lack any protection. Accordingly, it is a goal of the present invention to provide a security device that would be simple to install and use while providing a high degree of protection against theft and/or loss of data.

SUMMARY OF THE INVENTION

In accordance with the invention there is provided a pluggable security device for protecting an electronic device, comprising:

a tamper-resistant enclosure;

a connector for plugging the security device to the electronic device;

an alarm sound source for producing an audible alarm sound;

a battery for providing electrical power to the pluggable security device; and a microprocessor unit (MPU) for controlling the pluggable security device;

wherein the alarm sound source, the battery, and the MPU are disposed within the enclosure;

wherein the MPU is configured to generate an alarm including activating the alarm sound source, in response to a first alarm triggering event; and wherein the MPU includes a non-volatile memory unit for storing device operational policies and/or configuration settings.

Preferably, the pluggable security device has an accelerometer for sensing acceleration, disposed within the enclosure, wherein the connector is rigidly attached to the enclosure, and wherein the first alarm triggering event includes the acceleration sensed by the accelerometer exceeding an acceleration threshold. Further, preferably, the acceleration threshold is adjustable by a user.

Further, preferably, the tamper-resistant enclosure is absent any user-accessible controls. Thus, the security device of the invention provides all the security features therein, including the device operational policies and configuration settings, which greatly reduces any possibility of tampering or unauthorized disabling of the security system.

The control software, once installed, causes the electronic device and/or the security device to be responsive to a second alarm triggering event, which may include unplugging of the security device from the electronic device, switching the electronic device from an external power source to an internal battery, a failed user authentication attempt or a pre-defined number of failed authentication attempts, and unplugging the electronic device from a network. The response of the electronic device may include sounding an audible alarm by the alarm sound source of the pluggable security device, sounding an audible alarm by the electronic device, locking the electronic device, and dismounting encrypted data storage devices. In this context, the terms "first" and "second" are not intended to denote an order of occurrence of the events. Rather, they are simply name identifiers.

In accordance with another aspect of the invention there is further provided a security system comprising the pluggable security device and a security server connected to the electronic device through a network, wherein the security server is configured to be responsive to disconnecting the electronic device from the network, by sending an electronic message to a user and/or a manager of the electronic device.

The alarm can be tripped by any of the following events: sensing acceleration above the pre-defined threshold, detecting unplugging of the pluggable security device from the electronic device, detecting disconnection of the electronic device from a network, detecting a failed authentication attempt, and/or detecting switching of the electronic device from an external power source to an internal power source. The reaction to an alarm triggering event may include sounding an alarm in the pluggable security device and/or sounding an alarm in the electronic device, triggering data encryption in the electronic device, locking the electronic device, and/or sending, from a dedicated server connected through a network to the electronic device, a message to a user and/or a manager of the electronic device. Preferably, the triggering events and reactions are a part of a user definable policy that is appropriate to a particular use of the pluggable security device and may include any combination of the above stated alarm triggering events and/or alarm actions.

In accordance with yet another aspect of the invention there is further provided a method of protecting an electronic device, comprising:

(a) providing the pluggable security device;

(b) plugging the security device into the electronic device; and (c) activating the security device to be responsive to an alarm triggering event.

BRIEF DESCRIPTION OF THE DRAWINGS

Exemplary embodiments will now be described in conjunction with the drawings in which.

DETAILED DESCRIPTION OF THE INVENTION

While the present teachings are described in conjunction with various embodiments and examples, it is not intended that the present teachings be limited to such embodiments. On the contrary, the present teachings encompass various alternatives, modifications and equivalents, as will be appreciated by those of skill in the art.

A security system of the present invention is comprised of three interacting components: the hardware, the software, and the policy. All three are described in detail below, in the same order.

The Hardware

Figure 1:
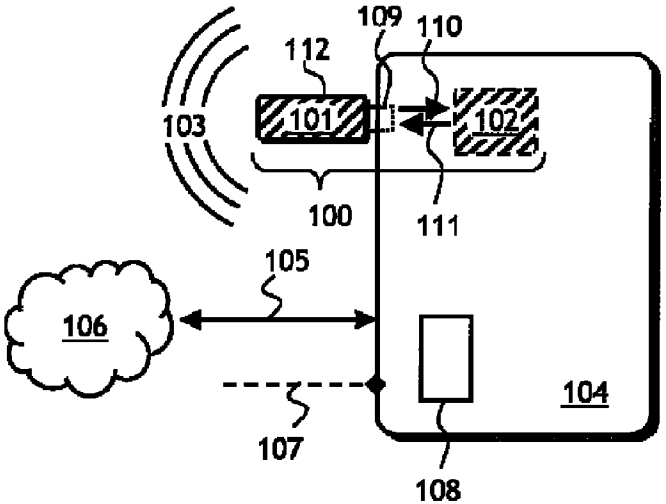
FIG. 1 is a diagrammatic view of a security system of the present invention for protecting an electronic device from tampering or theft.

Referring to FIG. 1, a security system 100 of the present invention is shown. The security system 100 is operable to protect an electronic device 104 such as a laptop computer. The security system 100 has a security device 101 plugged into the electronic device 104, and a control software 102 installed in the electronic device 104. The pluggable security device 101 has an alarm sound source, not shown in FIG. 1, for producing an audible alarm sound 103 upon triggering an alarm. The alarm can be triggered by an optional internal accelerometer, not shown, by unplugging of the security device 101 from the electronic device 104, by switching the electronic device from an external power line 107 to an internal battery 108, by failing user authentication at the electronic device 104, or by unplugging a network cable 105 connecting the electronic device 104 to a network 106. In the embodiment shown, the security device 101 and the electronic device 104 are connected using a Universal Serial Bus (USB) connector 109. The USB connector 109 of the pluggable security device 101 is rigidly attached to a tamper-resistant enclosure 112. The term "rigidly attached" is meant to denote an attachment that mechanically couples the security device 101 and the electronic device 104, so that the optional accelerometer disposed in the security device 101 can sense the acceleration or movement of the electronic device 104. Preferably, the tamper-resistant enclosure 112 comprises a water resistant, reinforced crush-proof structure that inhibits interruption of the siren tone 103 by attempts of physical destruction. The dome construction of the siren's sound chamber, baffles and optimized siren tone make obfuscating the siren sound 103 difficult.

The control software 102 is downloaded from a suitable source, such an optical disk or a remote secure FTP server, and installed in the electronic device 104. Once the installation is finished, the control software 102 is activated, at which point both the security device 101 and control software 102 can be configured. The security system 100 can then be armed to become responsive to some, or all, of the above mentioned alarm triggering events. Once an alarm triggering event is detected by either the security device 101 or by the control software 102, the triggering event is communicated across the USB connector 109, as illustrated by arrows 110 and 111, so that the alarm signals in both the security device 101 and the electronic device 104 can be sounded simultaneously. Preferably, the tamper-resistant enclosure 112 of the security device 101 has no user-accessible controls on its outer surface, so that the only way to control the security device 101 is through the control software 102. This arrangement makes any tampering with the security system 100 very difficult.

Figure 2:
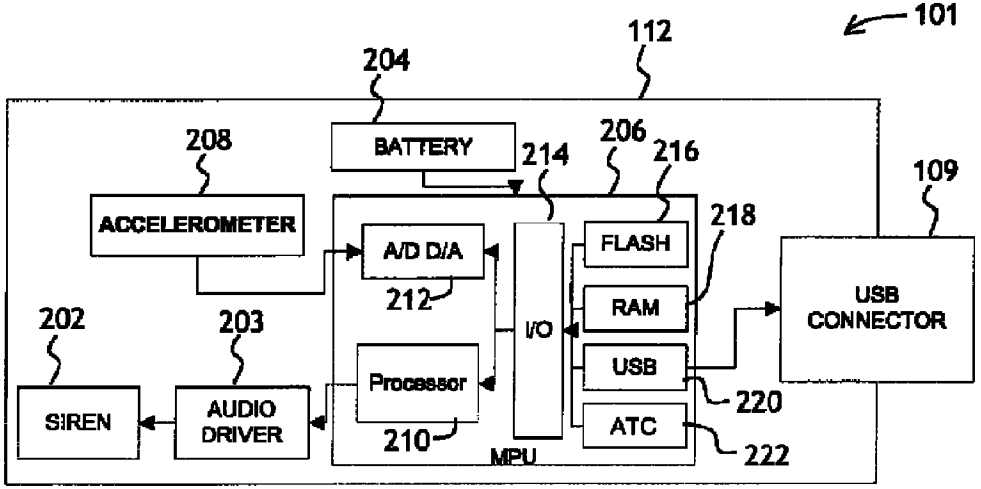
FIG. 2 is a block diagram of the pluggable security device shown in FIG. 1.

Referring now to FIG. 2, a block diagram of the pluggable security device 101 is shown. Disposed within the enclosure 112 are a siren 202 for producing the alarm sound 103, an audio driver 203 for driving the siren 202, a battery 204 for providing electrical power to the security device 101, a microprocessor unit (MPU) 206 for controlling the security device 101, and an accelerometer 208 for sensing acceleration. The MPU 206 has a processor 210, an analog to digital (A/D) and digital to analog (D/A) converter 212, an input/output (I/O) bus 214, a non-volatile memory unit 216 containing the alarm policy and the configuration settings, a RAM unit 218, and a USB interface 220. Herein, the term "non-volatile memory unit" is taken to mean a memory unit that does not require a power source to maintain its contents, such as a flash memory unit. The alarm triggering conditions containing a list of events that cause triggering of the security device 101 are symbolically shown at 222.

In operation, the security device 101 is plugged into the electronic device 104, and the control software 102 is downloaded by the user from an external carrier to the electronic device 104. After the control software 102 is installed in the electronic device 104, various operation parameters of the security device 101 can be set by the user using a data input device of the electronic device 104, such as a keyboard, for example. After this, the electronic device 101 can be armed to be responsive to the alarm triggering conditions 222. More details on the operational states of the security system 100 will be provided below, in a section entitled "The Software".

Once aimed, the electronic device 101 begins to monitor the acceleration signal provided by the accelerometer 208 and digitized by the A/D D/A converter 212. When the acceleration sensed by the accelerometer 208 exceeds a pre-defined threshold, the processor 210 provides a control signal to the audio driver 203, which energizes the siren 202 to emit the alarm sound 103. Preferably, the acceleration threshold is adjustable by a user of the electronic device 104. The processor 210 also sends a trigger signal to the control software 102 to trigger the alarm sound by the electronic device 104.

The acceleration threshold can be also adjusted based on a "test handling" of the electronic device 104, by using the accelerometer 208 of the security device 101 to measure the acceleration during the "test handling" and setting the acceleration threshold accordingly. Following is a succession of steps required to set the acceleration threshold:

(a) plugging the security device 101 into the electronic device 104;

(b) handling the electronic device 104;

(c) while performing step (b), using the accelerometer 208 to measure a magnitude of acceleration of the security device 101; and (d) adjusting the acceleration threshold to be equal to or above a maximum amplitude of acceleration measured in step (c).

Figure 3:
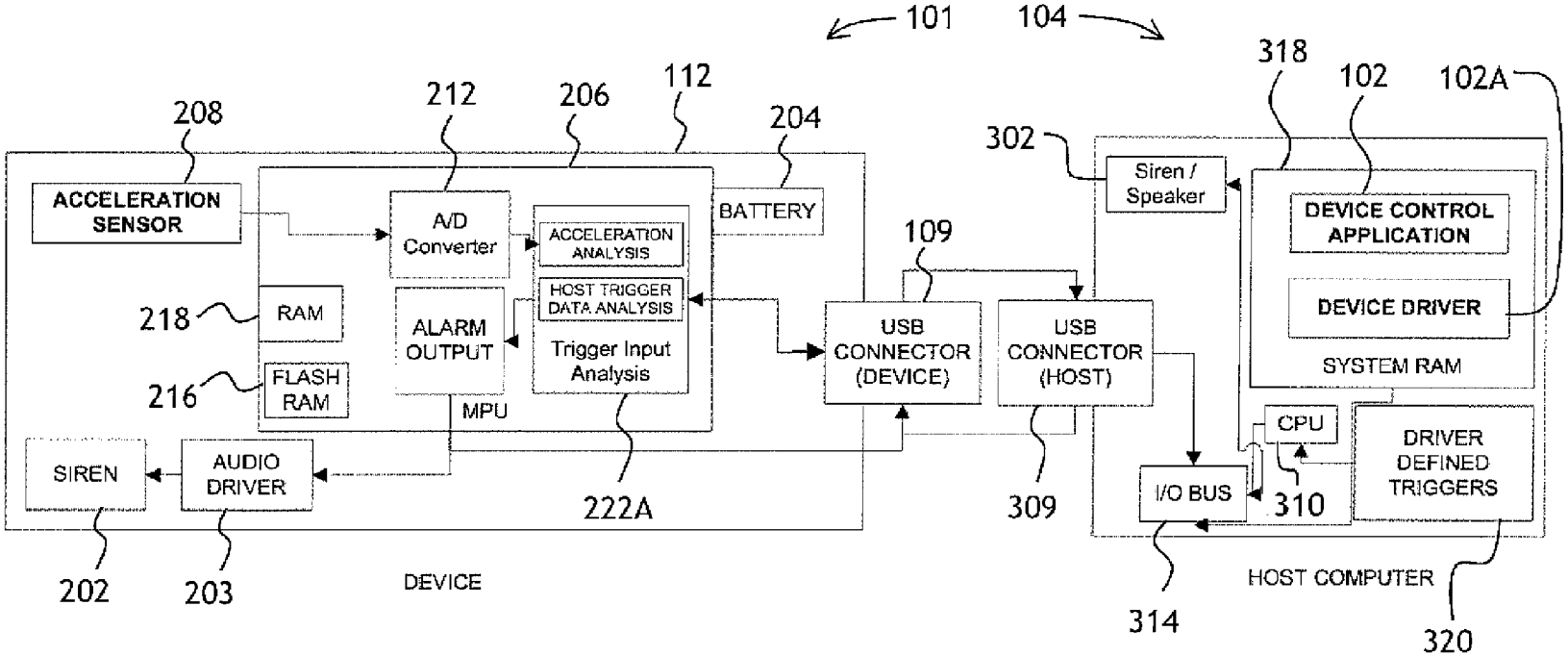
FIG. 3 is a block diagram of the security device of FIG. 1 plugged into the electronic device of FIG. 1.

Turning to FIG. 3, a block diagram of the security device 101 plugged into the electronic device 104 is shown. The electronic device 104 has a central processing unit (CPU) 310, system RAM 318, a speaker 302, an I/O bus 314, and a USB connector 309. The system RAM 318 hosts the active control software 102 and a device driver 102A. The control software 102 is configured to cause the electronic device 104 to be responsive to alarm triggering events shown symbolically at 320.

The alarm triggering events 320 include sensing an acceleration above the threshold, unplugging the security device 101 from the electronic device 104, switching the electronic device 104 from the external power line 107 to the internal battery 108, a failed user authentication attempt, or unplugging the electronic device 104 from the network 106. When at least one of the alarm triggering events 320 is detected, the control software 102 causes the CPU 310 to perform a number of actions referred to herein as alarm responses, or alarm reactions, such as: sounding a loud alarm signal from the speaker 302; locking the electronic device 104, for example locking the mouse pointer and opening a password entering window; and/or dismounting encrypted data storage devices of the electronic device 104.

Furthermore, upon detecting one or more of the triggering events 320, the control software 102 instructs the CPU 310 to send a message through the USB connectors 309, 109 to the MPU 206 of the security device 101, causing the MPU 206 to react by activating the siren 202. A box 222A symbolizes an area of RAM 218 of the MPU 206 containing commands to interpret messages from the electronic device 104 as well as to compare measured acceleration to a pre-defined threshold.

When the acceleration sensed by the accelerometer 208 of the security device 101 exceeds the pre-defined threshold, the processor 210 not only activates the siren 202, but also sends a message through the USB connectors 109, 309 to the CPU 310 of the electronic device 104, which performs the alarm responses as defined by the control software 102. The USB communication channel of the pluggable security device 101 affords the bidirectional communication between the electronic device 104 and the pluggable security device 101, to communicate activation state, as well as trigger state information, between the security device 101 and the electronic device 104.

The battery 204 is preferably a rechargeable lithium ion battery having a nominal voltage of 3V. The voltage on the lithium battery powers all electronics of the security device 101 and the siren 202, whether the USB 5V power source is present or not. In operation, the processor 210 detects the unplugging of the security device 101 from the electronic device 104 by detecting the absence of the 5V USB bus voltage.

Although it might seem convenient to construct the security device 101 so that the firmware of pluggable security device 101 can be updated from the electronic device 104, this is not recommended for security reasons. Instead, in-circuit reprogramming is preferably used. This would greatly simplify the overall software complexity and not introduce a new security weak point. To update the firmware of the pluggable security device 101 using in-circuit reprogramming, the case 112 has to be removed and an appropriate programming fixture attached. It is very difficult to do this in an already armed system. Furthermore, according to the present invention, an alarm triggering condition can include connecting to a programming port of the pluggable security device 101 (not shown) while in an armed state.

Figure 4:
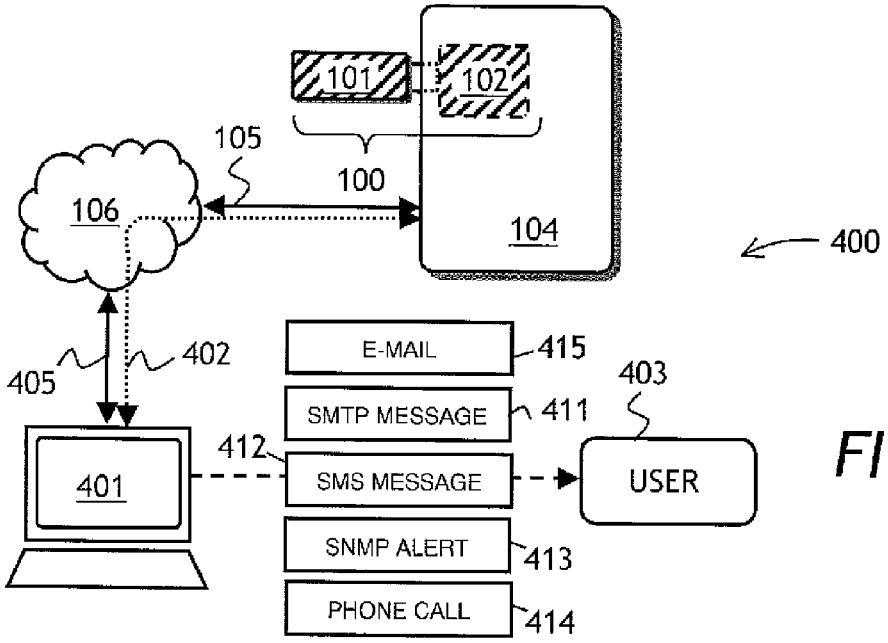
FIG. 4 is a block diagram of a security system having a dedicated security server connected to a network.

Turning now to FIG. 4, a security system 400 is shown having the pluggable security device 101, the control software 102 installed to the electronic device 104 connected to the network 106 with the network cable 105, and a security sever 401 connected to the network 106 with a cable 405. In operation, the security server 401 establishes a connection with the electronic device 104 through the network 106. The security server 401 periodically "pings" the electronic device 104 by sending "keep-alive" packets 402 which are returned by the electronic device 104 back to the security server 401. When the electronic device 104 is disconnected from the network 106, or is rendered unresponsive in any other way, the security server 401 can no longer receive back the keep-alive packets 402. As soon as the security server 401 does not receive one or more keep-alive packets 402, it sends a message to a user 403 of the electronic device 104, by sending at least one of a Simple Mail Transfer Protocol (SMTP) message 411, a Short Message Service (SMS) message 412, a Simple Network Management Protocol (SNMP) alert 413, an e-mail 415, or by making a phone call 414. This provides an additional layer of security.

Furthermore, in one embodiment, the security server 401 is configured to distribute the alarm policies among many security systems 100. In other words, the security server 401 provides a means for centralized policy of a response to an alarm.

The Software

Figure 5:
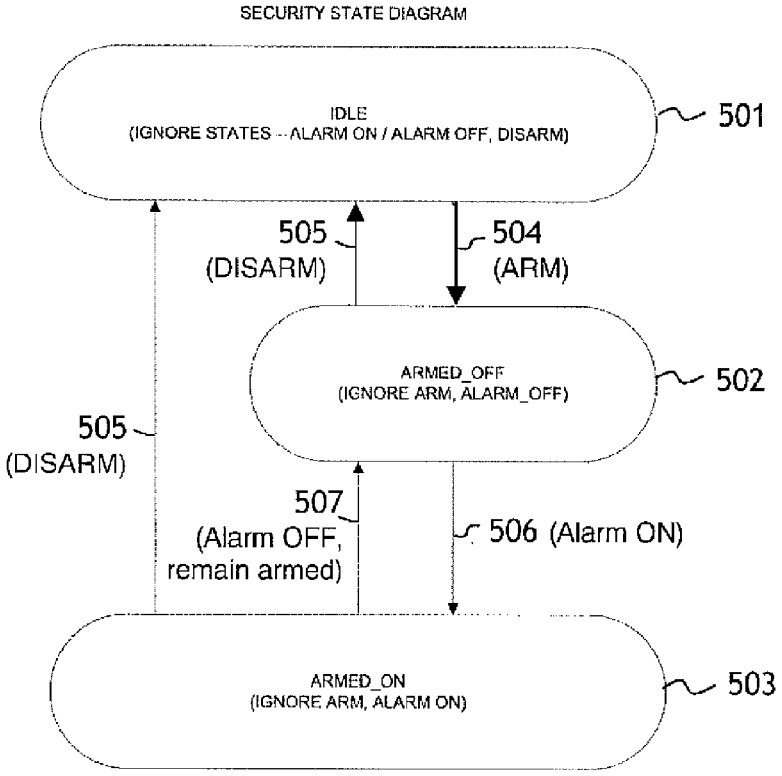
FIG. 5 is a diagram of states of the security systems of FIG. 4 and FIG. 1.

Referring to FIG. 5, a diagram of states of the security system 400 or the security system 100 is shown. A state 501 is an "IDLE" state. In this state, all alarm triggering events are ignored. This state is used to configure the software 102 according to an alarm triggering policy selected. This state is also used for normal work with the electronic device 104 when the security protection is not required.

A state 502 is an armed state before triggering by an alarm triggering event. The state 502 is denoted as "ARMED_OFF". When the security system 100 is in this state, any alarm triggering event defined by the alarm triggering policy will trigger the security system.

A state 503 is a triggered state, which occurs after the alarm has been tripped. The state 503 is denoted as "ARMED_ON". When the security system 100 is in this state, it performs a number of alarm actions defined by an alarm action policy, for example it activates the siren 202 to produce the alarm sound 103.

A transition 504 ("ARM") is a transition from the IDLE state 401 to the ARMED_OFF state 502. Its purpose is to arm the security system 100. The security system 100 can be armed by a user of the electronic device 104 causing the software 102 to send a corresponding command to the security device 101, or the system can be armed automatically, for example, at a specific time of day on a specific date, or after a period of inactivity, according to an alarm setting policy. The alarm triggering, action, and setting policies are described below in a section entitled "The Security Policy".

A transition 505 ("DISARM") is a transition from the ARMED_OFF state 502 or ARMED_ON state 503 back to the IDLE state 401. Its purpose is to disarm the security system 100. The security system 100 can be disarmed by plugging the security device back into the electronic device 104 if it has been unplugged from, and by entering a correct password.

A transition 506 ("Alarm ON") is a transition from the ARMED_OFF state 502 to the ARMED_ON state 503. It occurs when an alarm is triggered. Accordingly, a transition 507 ("Alarm OFF, remain armed") is a reverse transition from the ARMED_ON state 503 back to ARMED_OFF state 502. It occurs when the alarm is deactivated, but the system 100 needs to remain armed after deactivating the alarm.

Figure 6:
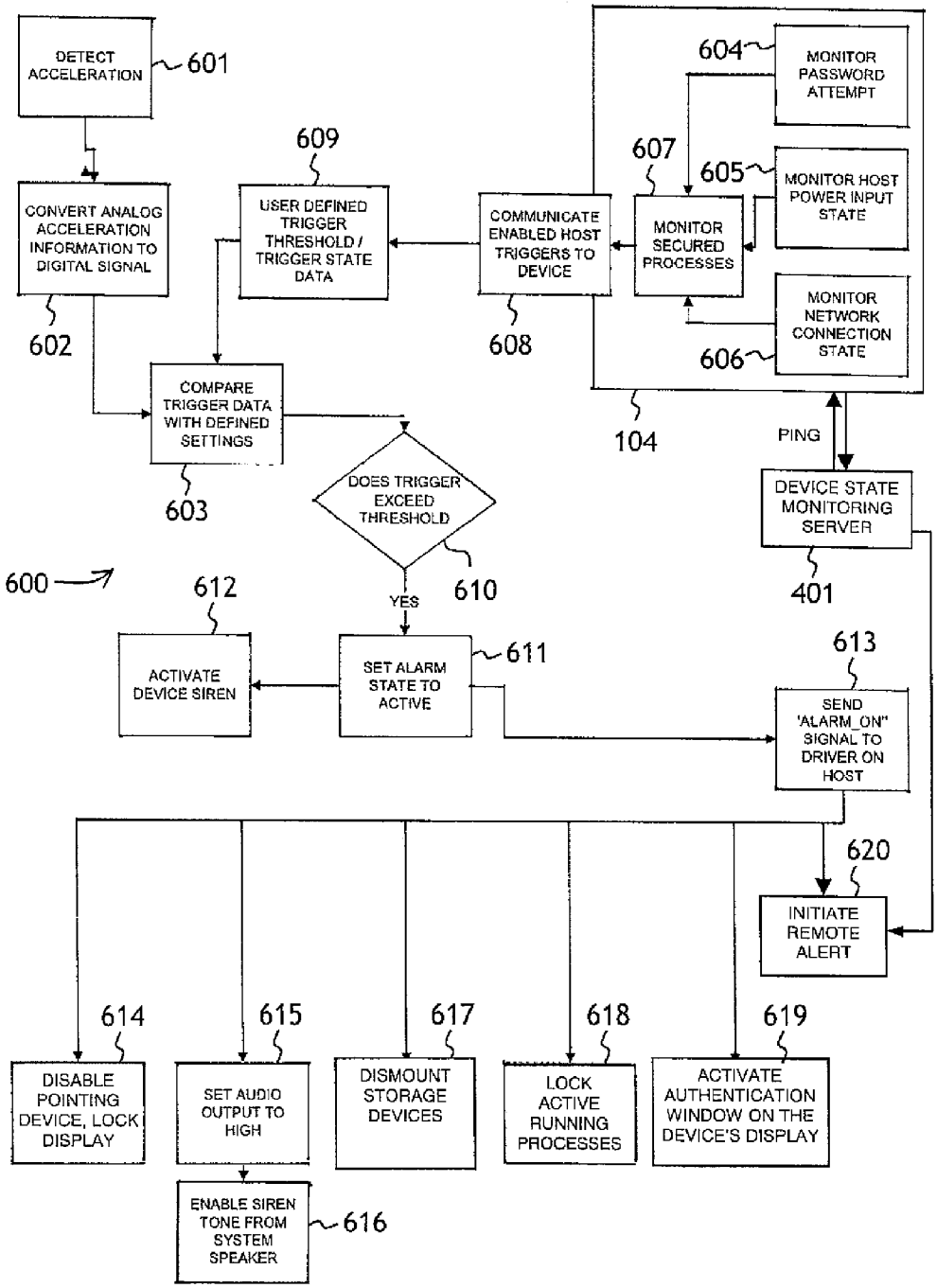
FIG. 6 is a flow chart of a security monitoring process run by the security system of FIG. 4.

Referring now to FIG. 6, a flow chart of an exemplary security monitoring process 600 is shown. The alarm can be triggered by any one of a pre-defined set of alarm triggering events. At a step 601, the accelerometer 208 detects acceleration and provides an analog acceleration signal, and at a step 602, the A/D D/A 212 converts the analog acceleration signal into a digital form. At a step 603, the acceleration value is compared to a pre-defined threshold. If the acceleration is found exceeding the threshold at a step 610, then at a step 611, the alarm system is set to the ARMED_ON state 503 discussed above, activating the siren 202 to produce the alarm sound 103.

The control software 102 includes a number of secured processes, such as monitoring password entering attempts shown at 604, monitoring the power source (the AC power line 107 or the battery 108) of the electronic device 104, shown at 605, and monitoring the state of the connection 105 to the network 106 of the electronic device 104, shown at 606. These processes are monitored in a process 607. At a step 608, the results are communicated to the security device 101. At the step 603, data including number of allowed password entering attempts, power source type, and the network connection state are compared with corresponding pre-defined threshold data 609 defined by an alarm triggering policy. If the data are found meeting the pre-defined criteria, for example if it is determined that a pre-defined number of unsuccessful password entries attempts is exceeded, if switching from the AC power line 107 to the internal battery 108 is detected, or if disconnection from the network 106 is detected, then, at the step 611, the security device 101 is set to the ARMED_ON state 503 and the siren 202 is activated at a step 612.

At a step 613, an "ALARM_ON" signal is sent to the device driver 102A of the electronic device 104. At a step 614, the control software 102 disables the pointing device and locks the display of the electronic device 104. At a step 615, the control software 102 sets the audio output of the electronic device 104 to "high" and, at a step 616, sounds the alarm through the speakers 302 of the electronic device 104. At a step 617, optional dismounting of an encrypted data storage device of the electronic device 104 is initiated. For example, the PGP Whole Disk Encryption™, TrueCrypt™, BitLocker™, WinMagic™, or other encryption application can be used to encrypt sensitive data. At a step 618, the active running processes are locked from any user input except for a password entry. At a step 619, an authentication window is activated on the display of the electronic device 104.

After the step 613 has been performed and the electronic device 104 has received the "ALARM_ON" message, a message is sent from the electronic device 104 to the security server 401 over the network 106 (if the electronic device 104 is still connected to the network 106) to initiate the remote alert messages 411 to 415 at a step 620. Even when the electronic device 104 is disconnected from the network 106, the security server 401 is capable of detecting the disconnection on its own, by sending the keep-alive packets 402 as described above. Once the disconnection is detected, the security server 401 sends the remote alert messages 411 to 415 at the step 620.

It is to be understood that even though the step 603 of comparing the trigger data with the defined thresholds is shown as taking place at the security device 101, an embodiment where this step is performed at the electronic device 104 is also possible. Furthermore, the alarm actions may also include activation of an optional Radio-Frequency ID (RFID) source activation. If this option is to be used, the RFID source would have to be installed into the electronic device 104, which may be detrimental for some applications.

Figure 7:
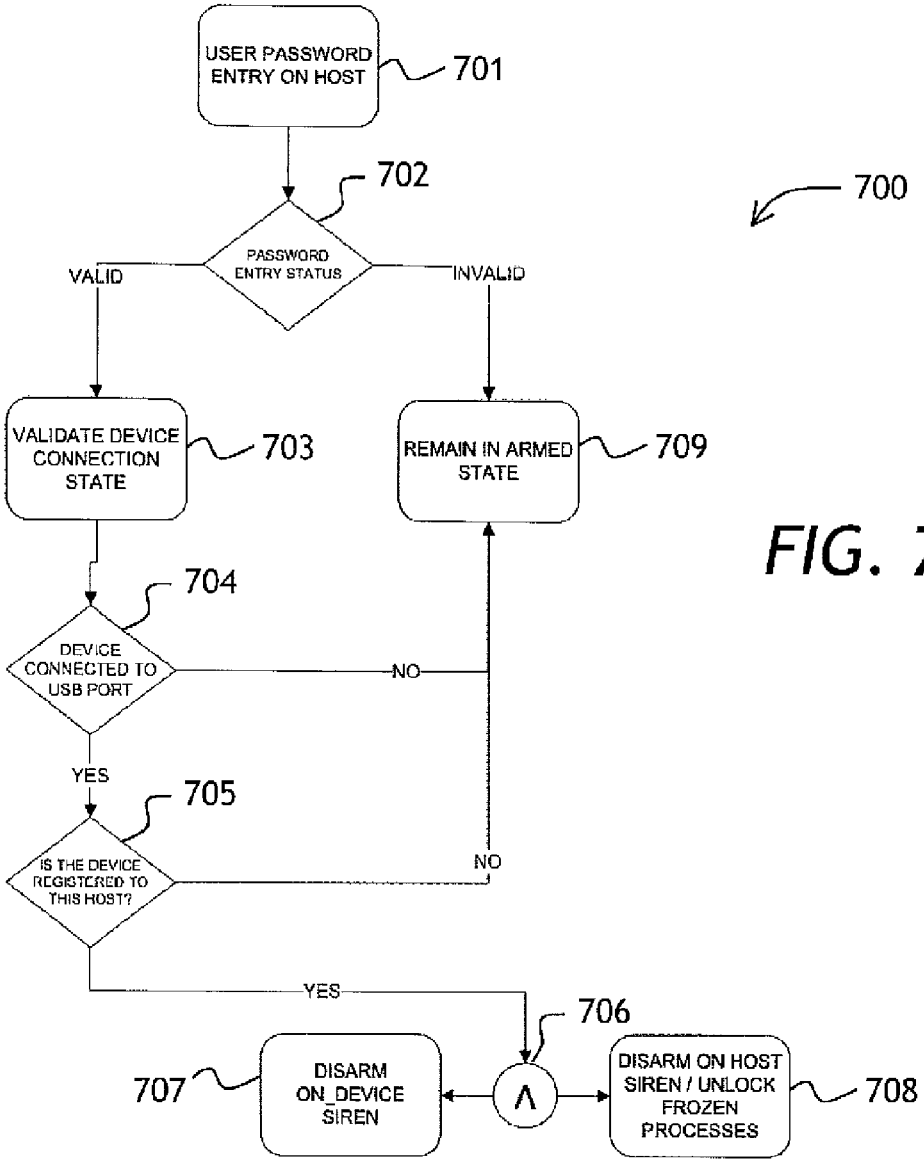
FIG. 7 is a block diagram of a disarming process in the security system of FIG. 1 or FIG. 4.

Turning now to FIG. 7, a block diagram of a disarming process 700 for disarming the security system 100 or 400, represented by the transition 505 or the transition 507 in FIG. 5, is shown. At a step 701, a user, for example the user 403, enters a password into a window shown on the display of the electronic device 104. At a step 702, the password verification is performed. If the password is found valid, the connection state of the security device 101 to the electronic device 104 is validated at a step 703. If at a step 704 the security device 101 is found connected to the electronic device 101, then at a step 705, the control software 102 determines whether the security device 101 is registered to the electronic device 104. If it is, then the disarming process 700 proceeds to a point 706, deactivating the siren 202 of the pluggable security device 101 at a step 707, and deactivating the alarm sound and unlocking the processes run in the electronic device 104 at a step 708. If the security device 101 is found not connected to the electronic device 104 at the step 704, or if the security device 101 is found not registered to the electronic device 104 at the step 705, then the security system 100 or 400 remains is the ARMED_OFF state 502 or the ARMED_ON state 503, as the case may be. This state is shown at 709.

The following Table 1 lists some of the commands and messages receivable by the control software 102 of the electronic device 104.

TABLE 1

| Signal | Description |
|---|---|
| ARM | User command to arm the system 100 |
| DISARM | User command to disarm the system 100 |
| ALARM OFF | User command to turn the alarm off |
| FAILED LOGIN | Multiple failed authentication/login attempts detected |
| AC POWER UNPLUG | The AC power line 107 is disconnected |
| NETWORK UNPLUG | The network cable 105 is unplugged |
| USB KEY UNPLUG | The security device 101 is unplugged |
| INAPPROPRIATE TIME | Activity outside of appropriate time window is detected |

TABLE 1-continued

| Signal | Description |
|---|---|
| ALARM ON | Message from the security device 101 to turn the alarm signal ON |
| REPORT STATUS | Message from the security device 101 to report current status |

The following Table 2 lists some of the messages that can be sent by the control software 102 from the electronic device 104 to the security device 101.

TABLE 2

| Signal | Description |
|---|---|
| ARM | Message from the electronic device 104 to arm the pluggable security device 101 |
| DISARM | Message from the electronic device 104 to disarm the pluggable security device 101 and ignore all trigger signals |
| ALARM ON | Message from the electronic device 104 to turn the siren 202 of the pluggable security device 101 ON |
| ALARM OFF | Message from the electronic device 104 to turn the siren 202 of the pluggable security device 101 OFF |
| CONFIG | Message from the electronic device 104 to configure the pluggable security device 101. System must be in the IDLE mode 501 for the message to be accepted |
| GET STATUS | Message from the electronic device 104 to gather information about the pluggable security device 101. This message can be sent periodically to allow the control software 102 to monitor the presence of the pluggable security device 101. It can also be used to monitor the health of the pluggable security device 101 |

The list of alarm triggering events, the list of the alarm actions, and the particulars of arming and disarming of a security system of the present invention are defined by a security policy. The security policy is selected based on a particular security application.

The Security Policy

Figure 8:
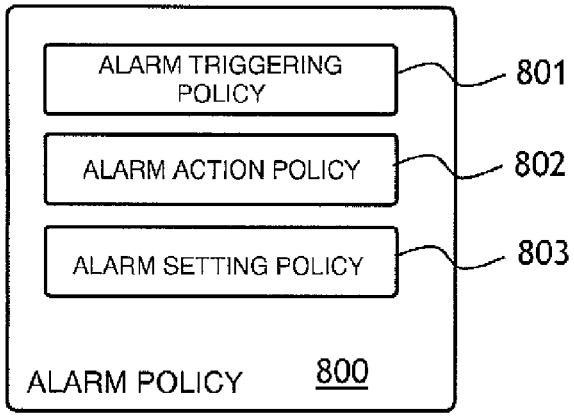
FIG. 8 is a block diagram of an alarm policy according to the invention.

Referring to FIG. 8, a block diagram illustrating main components of an alarm policy 800 is shown. The alarm policy 800 has an alarm triggering policy component 801, an alarm action policy component 802, and an alarm setting policy component 803.

The alarm triggering policy component 801 is used to determine which events trip the alarm causing the transition from the ARMED_OFF state 502 to the ARMED_ON state 503. These events may include:

(a) unplugging of the pluggable security device 101 from the electronic device 104;

(b) disconnecting the electronic device 104 from the network 106:

i. detected by the electronic device 104; and/or ii. detected by the security server 401;

(c) a failed authentication attempt;

(d) switching of the electronic device 104 from an external power source, such as the AC power line 107, to an internal power source, such as the battery 108; and (e) acceleration sensed by the accelerometer 208 exceeding the acceleration threshold.

The alarm action policy component 802 is used to determine what actions must be performed by the security system 100 while in the ARMED_ON state 503. These actions may include:

(a) sounding the alarm 103 by the alarm sound source (siren 202) of the pluggable security device 101;

(b) sounding an alarm through the speakers 302 of the electronic device 104;

(c) triggering dismounting of an encrypted volume in the electronic device 104;

(d) locking the electronic device 104 from any user input other than a password entry; and (e) sending, from the security server 401 connected through the network 106 to the electronic device 104, a message to the user 403 of the electronic device. This message can include: an email; and/or a SMS message; and/or a SMTP alert; and/or a SNMP alert; and/or a phone call.

The alarm setting policy component 803 is used to determine conditions for the security system 100 to enter the ARMED_OFF state 502. These conditions may include (a) time of the day;

(b) period of inactivity of the electronic device; and (c) user activation or deactivation through a configuration interface software installed on the electronic device 104.

The alarm setting policy component 803 can also be used to determine conditions for the security system 400 to enter the IDLE state 501, that is, the conditions for disarming the system.

Preferably, the policy profiles can be stored in file format at the security server 401 and applied by an administrator of the security server 401 depending on particular security needs of the user 403.

The alarm activations 506 in individual security systems 100 connected through the network 106 to the security server 401 can result in either sounding local alarms, or they can optionally deliver alerts to remote devices, or services. Similarly to a traditional alarm system issues an alert to a monitoring central, the security system 400 can provide the user 403 with the option of issuing an alert to the owner of the asset via SMS message, or e-mail; or where the asset is operating or owned by an enterprise, the security system 100 can issue the SMTP or the SNMP alert to the security administrator.

In the event of the ALARM_ON state 503, or the loss of a sequence of the keep-alive packets 402, the security server 401 will initiate a policy based action, where the security server 401 will issue the specified messages via the defined modes of communication to the administrator specified addresses. The security server 401 can be implemented in either an enterprise environment or as an Internet connected service depending on the requirements and environment of the client. For example, for a consumer or home user a standalone mode is appropriate, where the user is alerted of a theft by the issuance of the siren tone 103, and the locking of the electronic device 104 from unauthorized access.

For an enterprise user, or for an office user, activation 506 of the alarm will result in sounding the siren tone 103, and will cause an alert to be issued to the security server 401 located at a client data center, and managed by the client. This will protect the electronic device 104 in a standalone mode when the electronic device 104 is external to the office, and as part of an enterprise security system when the electronic device 104 is connected to the client network. The enterprise service can also provide external alerts to users or administrators via the following messages or alerts:

(a) an SMS message to a user or managers cell phone;

(b) an SNMP network alert to the client's enterprise security monitoring and management system;

(c) an e-mail to the user or any number of managers; or (d) a telephone call to any specified number.

For a global user, the user can opt to have their security systems 100 issue an alert to a global management server, which will responsively issue an alert via a number of communication methods to parties specified in the security policy. These actions can include:

(a) an SMS message to a user or managers cell phone;

(b) an SNMP network alert to the client's enterprise security monitoring and management system;

(c) an e-mail to the user or any number of managers; or (d) a telephone call to any specified number.

Many variations and modifications of the security system 100 or 400 are possible without departing from the invention. Various connectors, processors, sirens or buzzers can be used, for example. Various types of acceleration sensors can be used, including piezo sensors or MEMS sensors. The electronic devices can include laptop computers, tablet computers, desktop computers, industrial computers, automated tellers, pay stations, digital books, and other electronic devices. It is not intended to be exhaustive or to limit the invention to the precise form disclosed. It is therefore intended that the scope of the invention be limited not by this detailed description, but rather by the claims appended hereto.

What is claimed is:

1. A security device, comprising:

an enclosure;

a connector for plugging the security device to an electronic device and providing a first electrical connection to the electronic device, wherein the electronic device also has a separate second electrical connection to a computer network;

an alarm sound source disposed within the enclosure and being configured to produce an audible alarm sound; and a microprocessor unit (MPU) disposed within the enclosure and being configured to control the security device, wherein the MPU is configured to generate an alarm including activating the alarm sound source in response to detecting disconnection of the electronic device from the computer network.

2. The security device of claim 1, further comprising a battery disposed within the enclosure for providing electrical power to the alarm sound source and the MPU.

3. A system, comprising:

a first pluggable security device configured to be plugged into a first electronic device for providing security protection for the first electronic device, wherein the first pluggable security device comprises:

an enclosure;

a connector for plugging the first pluggable security device to the first electronic device and providing a first electrical connection to the first electronic device;

an alarm sound source disposed within the enclosure and being configured to produce an audible alarm sound; and a microprocessor unit (MPU) disposed within the enclosure and being configured to control the first pluggable security device; and a security server configured to be connected to the first electronic device through a computer network via a second electrical connection to the electronic device separate from the first electrical connection, wherein the security server is configured to store first configuration data defining a security policy for the first pluggable security device, and wherein the security server is configured to distribute the first configuration data to the first security device via the computer network and the first electronic device, and wherein the first configuration data includes at least one of: (1) data defining an alarm triggering policy for the first pluggable security device, the alarm triggering policy defining a set of events which will cause the first security device to trigger an alarm; and (2) data defining an alarm action policy for the first pluggable security device, the alarm action policy defining a set of actions to be taken in response to an alarm being triggered, wherein the first pluggable security device is configured in response to the first configuration data, and wherein the MPU is configured to generate an alarm including activating the alarm sound source, in response to detecting disconnection of the first electronic device from the computer network.

4. The system of claim 3, further comprising a second pluggable security device configured to be plugged into a second electronic device for providing security protection for the second electronic device, wherein the security server is configured to store second configuration data defining a security policy for the second pluggable security device, and wherein the security server is configured to distribute the second configuration data to the second security device via the computer network and the second electronic device, and wherein the second configuration data includes at least one of: (1) data defining an alarm triggering policy for the second pluggable security device, the alarm triggering policy defining a set of events which will cause the second security device to trigger an alarm; and (2) data defining an alarm action policy for the second pluggable security device, the alarm action policy defining a set of actions to be taken in response to an alarm being triggered, wherein the second pluggable security device is configured in response to the second configuration data, and wherein the second configuration data is different from the first configuration data.

5. The system of claim 3, wherein the first configuration data includes the data defining the alarm triggering policy for the first pluggable security device.

6. The system of claim 5, wherein the alarm triggering policy comprises triggering an alarm in response to a user definable subset of a set of alarm triggering events comprising:

unplugging of the pluggable security device from the first electronic device;

detecting an acceleration of the first pluggable security device that is greater than an acceleration threshold;

disconnecting the electronic device from the computer network;

detecting a failed authentication attempt; and switching of the first electronic device from an external power source to an internal power source.

7. The system of claim 3, wherein the first configuration data includes the data defining the alarm action policy for the first pluggable security device.

8. The system of claim 7, wherein the alarm action policy comprises a user definable subset of a set of alarm actions comprising:

sounding an alarm in the first pluggable security device;

sounding an alarm in the first electronic device;

dismounting an encrypted data storage device in the first electronic device;

locking the first electronic device; and sending, from the security server a message to a user of the first electronic device.

9. The system of claim 3, wherein the security server is further configured to periodically ping the first electronic device via the computer network, and in response to the security server not receiving a response to a ping of the first electronic device, to send a message from the security server indicating a security problem with the first electronic device.

10. The system of claim 3, wherein the first pluggable security device further comprises a battery disposed within the enclosure for providing electrical power to the alarm sound source and the MPU.

11. A method, comprising:

providing a first pluggable security device configured to be plugged into a first electronic device, via a first electrical connection of the electronic device, for providing security protection for the first electronic device;

providing a security server configured to be connected to the first electronic device through a computer network via a second electrical connection to the electronic device separate from the first electrical connection;

storing at the security server first configuration data for the first pluggable security device defining a security policy for the first pluggable security device;

communicating the first configuration data from the security server to the first electronic device via the computer network;

communicating the first configuration data from the first electronic device to the first pluggable security device;

configuring the first pluggable security device in response to the first configuration data;

detecting a connection state between the first electronic device and the computer network; and activating an alarm sound source in the first pluggable security device in response to detecting disconnection of the first electronic device from the computer network, wherein the first configuration data includes at least one of: (1) data defining an alarm triggering policy for the first pluggable security device, the alarm triggering policy defining a set of events which will cause the first pluggable security device to trigger an alarm; and (2) data defining an alarm action policy for the first pluggable security device, the alarm action policy defining a set of actions to be taken in response to an alarm being triggered.

12. The method of claim 11, further comprising:

providing a second pluggable security device configured to be plugged into a second electronic device for providing security protection for the second electronic device;

storing at the security server second configuration data defining a security policy for the second pluggable security device;

communicating the second configuration data from the security server to the second electronic device via the computer network;

communicating the second configuration data from the second electronic device to the second pluggable security device; and configuring the second pluggable security device in response to the second configuration data, wherein the second configuration data includes at least one of: (1) data defining an alarm triggering policy for the second pluggable security device, the alarm triggering policy defining a set of events which will cause the second pluggable security device to trigger an alarm; and (2) data defining an alarm action policy for the second pluggable security device, the alarm action policy defining a set of actions to be taken in response to an alarm being triggered, and wherein the second configuration data is different from the first configuration data.

13. The method of claim 11, wherein the first configuration data includes the data defining the alarm triggering policy for the first pluggable security device.

14. The method of claim 13, wherein the alarm triggering policy comprises triggering an alarm in response to a user definable subset of a set of alarm triggering events comprising:

unplugging of the first pluggable security device from the first electronic device;

detecting an acceleration of the first pluggable security device that is greater than an acceleration threshold;

disconnecting the first electronic device from the computer network;

detecting a failed authentication attempt; and switching of the first electronic device from an external power source to an internal power source.

15. The method of claim 11, wherein the first configuration data includes the data defining the alarm action policy for the first pluggable security device.

16. The method of claim 15, wherein the alarm action policy comprises a user definable subset of a set of alarm actions comprising:

sounding an alarm in the first pluggable security device;

sounding an alarm in the first electronic device;

dismounting an encrypted data storage device in the first electronic device;

locking the first electronic device; and sending, from the security server a message to a user of the first electronic device.

17. The method of claim 11, further comprising generating a reaction to an alarm, the reaction comprising at least one of:

sounding the audible alarm sound in the first pluggable security device; and sounding an audible alarm in the first electronic device.

18. The method of claim 11, further comprising:

the security server periodically pinging the first electronic device via the computer network; and in response to the security server not receiving a response to a ping of the first electronic device, sending a message from the security server indicating a security problem with the first electronic device.

* * * * *